US008190043B2

(12) United States Patent
Gross et al.

(10) Patent No.: US 8,190,043 B2
(45) Date of Patent: May 29, 2012

(54) TONER IMAGE PROCESSING MACHINE WITH CHARGE COMPENSATION AND METHOD THEREOF

(75) Inventors: Eric M. Gross, Rochester, NY (US); Yongsoon Eun, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 421 days.

(21) Appl. No.: 12/544,029

(22) Filed: Aug. 19, 2009

(65) Prior Publication Data

US 2011/0044707 A1 Feb. 24, 2011

(51) Int. Cl.
*G03G 15/00* (2006.01)

(52) U.S. Cl. ..... 399/49

(58) Field of Classification Search ..... 399/49, 399/50, 58, 60

See application file for complete search history.

(56) References Cited

U.S. PATENT DOCUMENTS 5,313,252 A * 5/1994 Castelli et al. ..... 399/49
6,201,936 B1 * 3/2001 Gross et al. ..... 399/49
6,223,006 B1 4/2001 Scheuer et al.
7,151,248 B2 * 12/2006 Harush et al. ..... 399/49
2006/0153582 A1 7/2006 Mo et al.
2008/0175610 A1 7/2008 Gross et al.

OTHER PUBLICATIONS

U.S. Appl. No. 12/190,335, filed Aug. 12, 2008, Wagner.

* cited by examiner

*Primary Examiner* — Susan Lee
(74) *Attorney, Agent, or Firm* — Simpson & Simpson, PLLC

(57) ABSTRACT

A method for compensating a charge retentive imaging surface for a photoreceptor in a toner image processing machine, the surface including a plurality of panels, each panel including a document printing zone (DPZ) and an interdocument zone (IDZ), and the machine including at least one specially programmed computer, at least one sensor, and charging members for charging the surface, including: measuring for each panel, using the sensor, first density values for a plurality of points in the DPZ, the DPZ in a printing region of the photoreceptor; measuring for each panel, using the sensor, a second density value for the IDZ; determining for each IDZ, using a processor in the computer, a respective compensated IDZ density value; and modifying operation of the charging members according to the compensated IDZ density values, such that the first density values for each panel are substantially centered with a desired density value.

12 Claims, 4 Drawing Sheets

TONER IMAGE PROCESSING MACHINE WITH CHARGE COMPENSATION AND METHOD THEREOF

TECHNICAL FIELD

The present disclosure relates to charge compensation for a photoreceptor in a toner image processing machine.

BACKGROUND

In xerographic printing apparatus having long, multi-pitch photoreceptor belts, there is a problem in maintaining consistent electrostatic properties along the entire circumference of the belt. For example, many photoreceptors are known to have a once-around variation in the electrostatic properties, due primarily to dielectric thickness variations commonly referred to as run-out, resulting from photoreceptor manufacturing operations. Uncompensated electrostatic properties will follow the once-around voltage profile of the photoreceptor and cause the average local charge level of the photoreceptor to change.

SUMMARY

According to aspects illustrated herein, there is provided a method for compensating a charge retentive imaging surface for a photoreceptor in a toner image processing machine, the charge retentive imaging surface including a plurality of panels, each panel including a document printing zone (DPZ) and an interdocument zone (IDZ), and the machine including at least one specially programmed computer, at least one sensor, and charging members for depositing charges on the charge retentive imaging surface, including: measuring for each panel, using the at least one sensor, first density values for a plurality of points in the DPZ, wherein the DPZ is in a printing region of the photoreceptor; measuring for each panel, using the at least one sensor, a second density value for the IDZ; determining for said each panel, using a processor in the at least one specially programmed computer, a variation of the first density values with respect to a desired density value; determining for each IDZ, using the processor, a respective compensated IDZ density value; determining, using the processor, a difference between the respective compensated IDZ density value and the desired value; and modifying operation of the respective charging members according to the difference, such that the first density values for said each panel are substantially centered with respect to the desired density value.

According to aspects illustrated herein, there is provided a toner image processing machine with charge compensation, including: a photoreceptor with a retentive imaging surface including a plurality of panels, each panel including a document printing zone (DPZ) and an interdocument zone (IDZ); at least one sensor; charging members for depositing charges on the charge retentive imaging surface; and at least one specially programmed computer including a processor. The at least one sensor is for: measuring, for each panel, first density values for a plurality of points in the DPZ, wherein each DPZ is in a printing region of the photoreceptor; and measuring, for said each panel, a second density value for the IDZ. The processor is for: determining a variation of the first density values with respect to a desired density value for said each panel; determining a respective compensated IDZ density values for each IDZ; determining a difference between each respective compensated IDZ density value and the desired value; and modifying operation of the respective charging members according to the difference, such that the first density values for said each panel are substantially centered with respect to the desired density value.

According to aspects illustrated herein, there is provided a method for compensating a charge retentive imaging surface for a photoreceptor in a toner image processing machine, the charge retentive imaging surface including a plurality of panels, each panel including a document printing zone (DPZ) and an interdocument zone (IDZ), and the machine including at least one specially programmed computer, at least one sensor, and charging members for depositing charges on the charge retentive imaging surface, including: measuring for each panel, using the at least one sensor, first density values for a plurality of points in the DPZ, wherein the DPZ is in a printing region of the photoreceptor; measuring for said each panel, using the at least one sensor, a second density value for the IDZ; determining for each IDZ, using a processor in the at least one specially programmed computer, a respective compensated IDZ density value; and modifying operation of the respective charging members according to the respective compensated IDZ density values, such that the first density values for said each panel are substantially centered with respect to a desired density value.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

Figure 1:
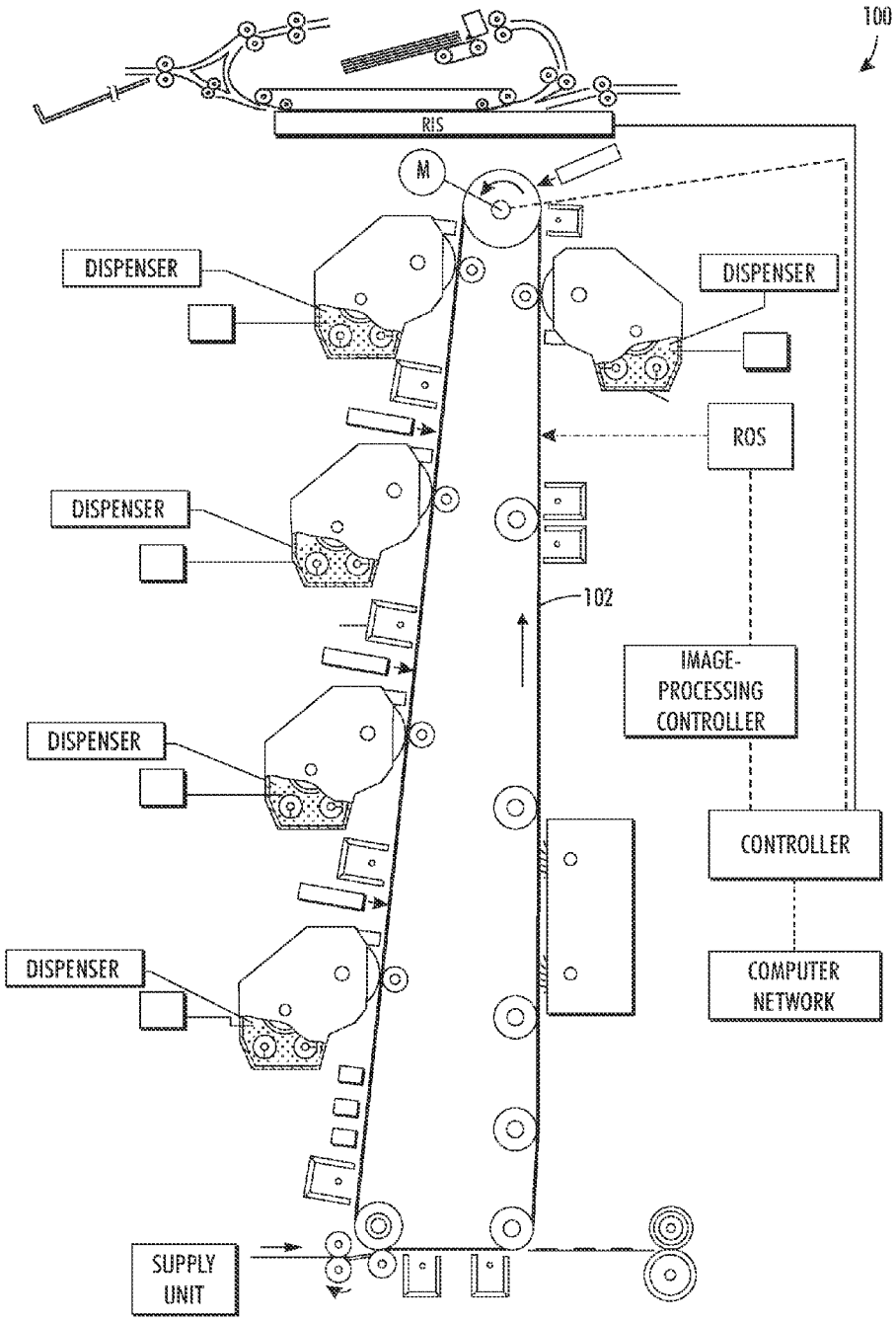
FIG. 1 is a schematic illustration of a toner image processing machine.

FIG. 1 is a schematic illustration of toner image processing machine 100 with photoreceptor belt 102. Machine 100 is usable for xerographic operations using xerographic controls. The terms "toner image processing machine," "machine," and "xerographic machine" are used interchangeably hereafter.

Figure 2:
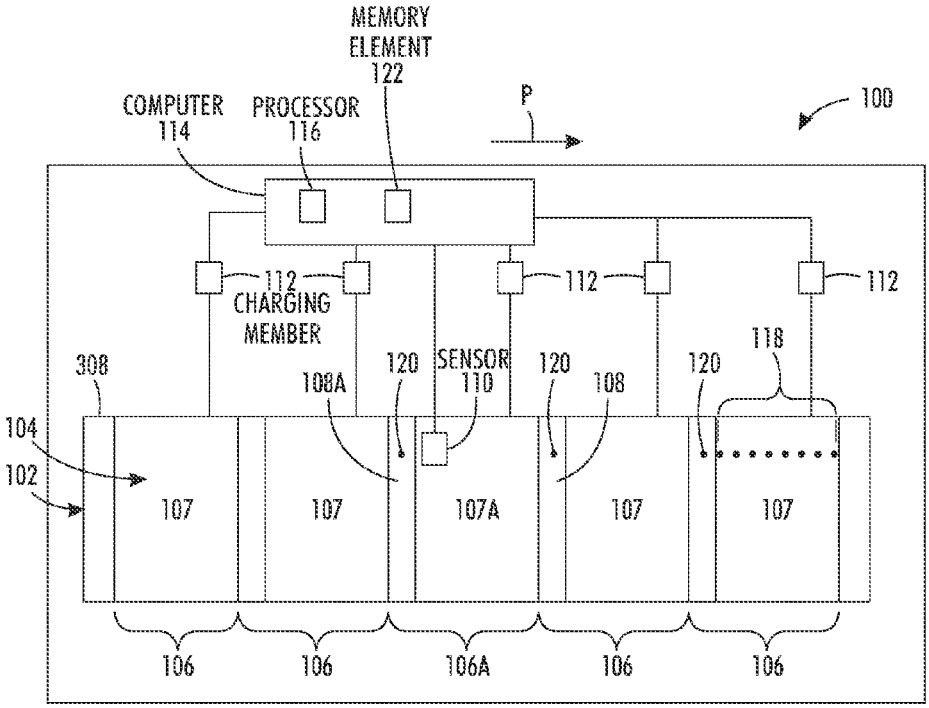
FIG. 2 is a diagrammatic illustration of a portion of the toner image processing machine in FIG. 1 including an "unrolled" portion of the photoreceptor belt.

FIG. 2 is a diagrammatic illustration of a portion of toner image processing machine 100 in FIG. 1 including an "unrolled" portion of photoreceptor belt 102. Photoreceptor 102 includes charge retentive imaging surface 104 with a plurality of panels 106 with respective document printing zones (DPZs) 107 and interdocument zones (IDZs) 108. Photoreceptor 102 is not limited to the number of DPZs and IDZs shown in the figure. The machine also includes at least one sensor 110, and charging members 112 for depositing charges on the charge retentive imaging surface. Each DPZ is in a printing region of the photoreceptor. That is, sheets of material upon which print is to be disposed by the machine are located in respective DPZs. Each charging member is individually controllable. Machine 100 also includes at least one specially programmed computer 114 including processor 116. Thus, machine 100 includes a control system for xerographic processes. Computer 114 and processor 116 can be any computer or processor known in the art.

Figure 3:
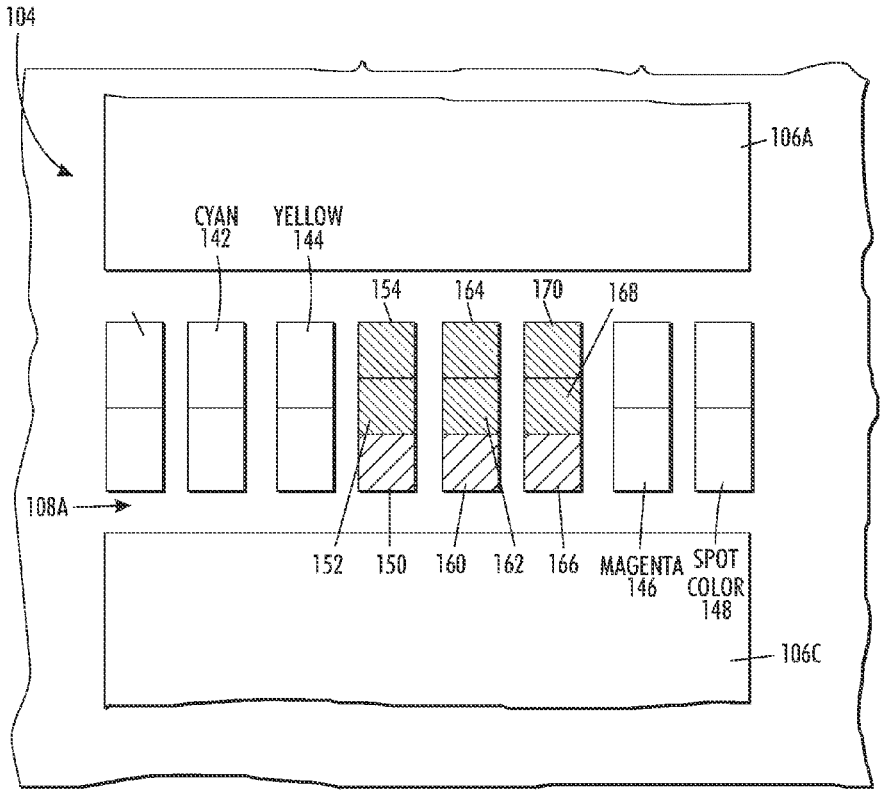
FIG. 3 is a detail illustrating control patches in an interdocument zone (IDZ) of a photoreceptor.

Machine 100 is not limited to a particular number or configuration of sensors. In one embodiment, for example, as shown in FIG. 2, sensor 110 is a single pixel. In one embodiment (not shown), sensor 110 includes a plurality of pixels, but covers less than the full width of the photosensor. In one embodiment (not shown), sensor 110 is a full width array sensor. A plurality of sensors or a full width array sensor, for example, as shown in FIG. 3 below, can advantageously run a plurality of tests simultaneously, for example, for multiple colors and for multiple patch levels inboard to outboard in machine 100. Testing is further described infra.

Sensor 110 measures density values for plurality of control points or control patches 118 in each DPZ. Hereafter, the terms "control point," "control patch," and "point" are used interchangeably. Any number of patches or points can be measured for each DPZ. In one embodiment, a same number of points is measured for each DPZ. In FIG. 2, nine points 118 are illustrated. To simplify presentation, the nine points are shown only for DPZ 107D. However, it should be understood that the remaining DPZs also are measured at nine points in this example. Sensor 110 also measures density values for points 120 in each IDZ. Although a single measured point is shown for each IDZ, it should be understood that other numbers of points can be measured in the IDZs. The measurements described supra can be taken during various operations of machine 100, for example, during cycle up, cycle down, or quality adjustment. Also, measurements can be obtained for solids, mids, highlights, or other density parameters.

FIG. 3 illustrates control patches in an IDZ of a photoreceptor. As noted supra, sensor 110 can vary from a single point pixel to a full width array sensor. FIG. 3 illustrates possible control patches in an IDZ, to be measured or tested by sensor 110. It should be understood that other configurations of control patches are possible. For example, IDZ 108A for DPZ 107A could include untoned and undeveloped patches: 140 for black, 142 for cyan, 144 for yellow, 146 for magenta and 148 for the spot color. For example, IDZ 108A also could include toned patches: 150 consisting of only yellow toner and two toned complementary patches 152 and 154 consisting of a blue (magenta plus cyan) patch and dark spot (black plus spot) patch, respectively.

A second set of three toned patches may comprise a patch 160 consisting of magenta toner and a pair of toned complementary patches comprising a green (cyan plus yellow) patch 162 and a dark spot (black plus spot) patch 164. The third set of three patches may comprise a patch 166 consisting of cyan toner and a pair of complementary patches comprising a red (magenta plus yellow) patch 168 and a dark spot (black plus spot) patch 170. The patches are disposed in intermediate full color image areas 172 and 174.

Figure 4:
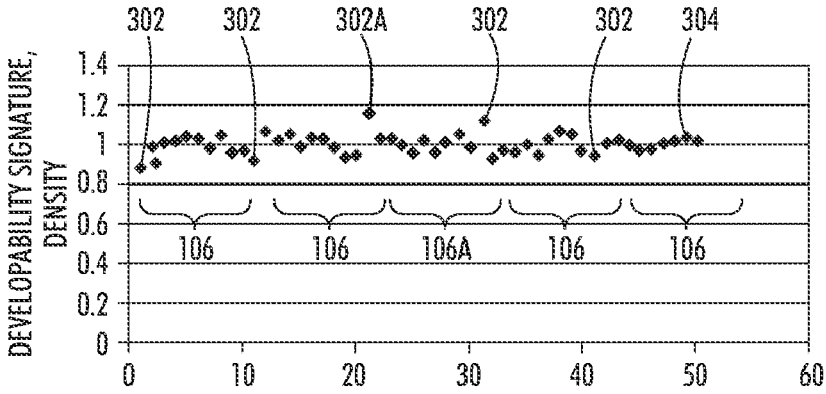
FIG. 4 is a graph showing uncompensated density values for panels for a photoreceptor.

FIG. 4 is graph 200 showing uncompensated density values for DPZs and IDZs for photoreceptor 102. In graph 200, the y axis is density and the x axis is position along photoreceptor 102 in process direction P. The variation in photoreceptors described supra can be manifested as a developability signature, for example, as exhibited by variation in density values for points along the circumference of the photoreceptor. Such a developability signature for photoreceptor 102 is shown in FIG. 4. Graph 200 shows density values 202 for points 118 (DPZs) and density values 204 for points 120 (IDZs). Under ideal conditions, density values 202 and 204 would be equal to a desired density level, for example, 1 in FIG. 4. However, in practice, actual density values 202 and 204 vary considerably from the desired level, for example, due to the variation in electrostatic properties for the photoreceptor described supra. As shown in FIG. 4, some variation of values 202 can occur within a panel and variations of values 202 can occur between panels. For example, on average, density values for DPZ 107B are greater than those for DPZ 107A. IDZs often receive different xerographic treatment over time (no paper present as that portion passes through the xerographic toner transfer subsystem), which creates additional differences between the electrical characteristics of DPZs and IDZs. Such differences can be accentuated with time and can be pitch mode dependent.

Figure 5:
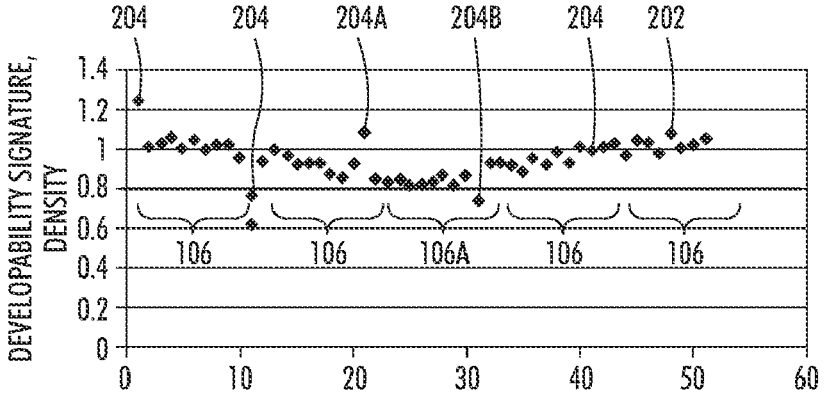
FIG. 5 is a graph showing compensation of density values shown in FIG. 4.

FIG. 5 is graph 300 showing compensation of density values 202 shown in FIG. 4. Graph 300 shows a developability signature for photoreceptor 102 after compensation performed according to the operations described infra.

Machine 100 in FIGS. 1 and 2 is suitable for implementing a compensation of a charge retentive imaging surface for a photoreceptor in a toner image processing machine, for example, to generate the results shown in FIG. 5, as follows. Processor 116 determines a variation of density values 202 for each DPZ with respect to a desired density value. In one embodiment, processor 116 determines the variation of a statistical parameter for the uncompensated density values with respect to the desired density value. Any statistical parameter known in the art can be used. In one embodiment, the statistical parameter is a median value for the uncompensated density values.

Processor 116 also determines a respective compensated IDZ density value for each IDZ (point 120) associated with a DPZ. As further described infra, the processor then modifies operation of the respective charging members using the respective compensated IDZ density values for the DPZs such that density values for the DPZs are substantially centered with respect to the desired density value. For example, for each panel, the processor determines a difference between the compensated IDZ density value and the desired value and modifies charging member operation with respect to the DPZ according to the difference.

In one embodiment, the processor determines for each panel, using the variation with respect to the desired density value, at least one respective panel density correction value. The at least one respective panel density correction value is used to modify the first density values to correct the variation with respect to the desired density value. For each panel, the processor determines the respective compensated IDZ density value using the respective panel density correction value. That is, the panel density correction values are correlated to the respective changes in density level desired for points in a panel.

In one embodiment, the processor is for identifying a statistical outlier among uncompensated density values for a DPZ and determining the variation of the uncompensated density values with respect to a desired density value without the statistical outlier. That is, the outlier is eliminated to prevent skewing of calculations due to the outlier.

In one embodiment, the compensated IDZ density values are stored in memory element 122 for the computer and are used to adjust the charging members during succeeding operations. That is, the compensated IDZ density values are not continually determined. In one embodiment, the compensated IDZ density values are determined and changed as necessary at various, for example, periodic, time intervals.

In the discussion that follows, approximations are presented for purposes of illustration only. It also should be understood that values and relationships shown in FIG. 5 are for purposes of illustration only and are not meant to be exact. For example, for DPZ 107A in FIG. 2, the processor determines that an average or median of uncompensated density values varies from desired value 1 by approximately 0.15. The processor then determines compensated IDZ density value 302A for IDZ 108A. The difference between compensated IDZ value 302A and the desired density level of 1 is used to adjust the charging member for panel 106A to generate compensated density values 304 for DPZ 107A. That is, operation of the charging members is controlled such that compensated density values 304 for a DPZ center a statistical parameter, for example, the mean, median, or any defined measure of central tendency, of density values for points in the DPZ.

In one embodiment, compensation is in process direction P, which does not amplify inboard to outboard density level variation.

Thus, the operations described supra control density readings at IDZs to respective independent target levels so as to reduce panel to panel density variation. For example, controlling density readings at IDZs to separate targets with the aim of centering the distribution of density levels among the DPZs in the panels. In general, a linear relationship holds so that adjusting the IDZ levels to targets modifies the image panel contact appropriately.

As noted supra, according to aspects illustrated herein, there is provided a method for compensating a charge retentive imaging surface for a photoreceptor in a toner image processing machine, the charge retentive imaging surface including a plurality of panels, each panel including a document printing zone (DPZ) and an interdocument zone (IDZ), and the machine including at least one specially programmed computer, at least one sensor, and charging members for depositing charges on the charge retentive imaging surface. In one embodiment, the method determines for said each panel, using the processor and the variation with respect to the desired density value, at least one respective panel density correction value to modify the first density values to correct the variation with respect to the desired density value and determining for each IDZ a respective compensated IDZ density value includes using the at least one respective panel density correction value.

In one embodiment, determining, for each panel, the variation of the first density values with respect to the desired density value includes determining a variation of a respective statistical parameter for the first density values with respect to the desired density value. In one embodiment, the respective statistical parameter is a respective median value for the first density values. In one embodiment, the method identifies for a panel, using the processor, a statistical outlier among the first density values and determining for each panel the variation of the first density values with respect to a desired density value includes eliminating the statistical outlier from the determination.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What we claim is:

1. A method for compensating a charge retentive imaging surface for a photoreceptor in a toner image processing machine, the charge retentive imaging surface including a plurality of panels, each panel including a document printing zone (DPZ) and an interdocument zone (IDZ), and the machine including at least one specially programmed computer, at least one sensor, and charging members for depositing charges on the charge retentive imaging surface, comprising:

measuring for each panel, using the at least one sensor, first density values for a plurality of points in the DPZ, wherein the DPZ is in a printing region of the photoreceptor;

measuring for each panel, using the at least one sensor, a second density value for the IDZ;

determining for said each panel, using a processor in the at least one specially programmed computer, a variation of the first density values with respect to a desired density value;

determining for each IDZ, using the processor, a respective compensated IDZ density value;

determining, using the processor, a difference between the respective compensated IDZ density value and the desired value; and, modifying operation of the respective charging members according to the difference, such that the first density values for said each panel are substantially centered with respect to the desired density value.

2. The method of claim 1 further comprising determining for said each panel, using the processor and the variation with respect to the desired density value, at least one respective panel density correction value to modify the first density values to correct the variation with respect to the desired density value and wherein determining for said each IDZ a respective compensated IDZ density value includes using the at least one respective panel density correction value.

3. The method of claim 1 wherein determining, for said each panel, the variation of the first density values with respect to the desired density value includes determining a variation of a respective statistical parameter for the first density values with respect to the desired density value.

4. The method of claim 3 wherein the respective statistical parameter is a median value for the first density values.

5. The method of claim 1 further comprising identifying for a panel, using the processor, a statistical outlier among the first density values and wherein determining for said each panel the variation of the first density values with respect to a desired density value includes eliminating the statistical outlier from the determination.

6. A toner image processing machine with charge compensation, comprising:

a photoreceptor with a charge retentive imaging surface including a plurality of panels, each panel including a document printing zone (DPZ) and an interdocument zone (IDZ);

at least one sensor;

charging members for depositing charges on the charge retentive imaging surface; and, at least one specially programmed computer including a processor, wherein the at least one sensor is for:

measuring, for each panel, first density values for a plurality of points in the DPZ, wherein each DPZ is in a printing region of the photoreceptor; and, measuring, for said each panel, a second density value for the IDZ;

wherein the processor is for:

determining a variation of the first density values with respect to a desired density value for said each panel;

determining a respective compensated IDZ density values for each IDZ;

determining a difference between each respective compensated IDZ density value and the desired value; and, modifying operation of the respective charging members according to the difference, such that the first density values for said each panel are substantially centered with respect to the desired density value.

7. The machine of claim 6 wherein the processor is for:

determining for said each panel, using the variation with respect to the desired density value, at least one respective panel density correction value to modify the first density values to correct the variation with respect to the desired density value; and, determining the respective compensated IDZ density value for said each panel using the at least one respective panel density correction value.

8. The machine of claim 6 wherein determining, for said each panel, the variation of the first density values with respect to the desired density value includes determining a variation of a respective statistical parameter for the first density values with respect to the desired density value.

9. The method of claim 8 wherein the respective statistical parameter is a respective median value for the first density values.

10. The machine of claim 6 wherein the processor is for:

identifying a statistical outlier among the first density values for a panel; and, determining for said each panel the variation of the first density values with respect to a desired density value without the statistical outlier.

11. A method for compensating a charge retentive imaging surface for a photoreceptor in a toner image processing machine, the charge retentive imaging surface including a plurality of panels, each panel including a document printing zone (DPZ) and an interdocument zone (IDZ), and the machine including at least one specially programmed computer, at least one sensor, and charging members for depositing charges on the charge retentive imaging surface, comprising:

measuring for each panel, using the at least one sensor, first density values for a plurality of points in the DPZ, wherein the DPZ is in a printing region of the photoreceptor;

measuring for said each panel, using the at least one sensor, a second density value for the IDZ;

determining for each IDZ, using a processor in the at least one specially programmed computer, a respective compensated IDZ density value; and, modifying operation of the respective charging members according to the respective compensated IDZ density values, such that the first density values for said each panel are substantially centered with respect to a desired density value.

12. The method of claim 11 further comprising determining for said each panel, using the processor, a variation of the first density values with respect to the desired density value and wherein determining for said each IDZ a respective compensated IDZ density value includes determining the respective compensated IDZ density value using the variation.

* * * * *